US008708450B2

(12) United States Patent
Li et al.

(10) Patent No.: US 8,708,450 B2
(45) Date of Patent: Apr. 29, 2014

(54) INDIRECT MEDIA FLATNESS MEASUREMENT

(75) Inventors: Faming Li, Solon, OH (US); Jing Zhou, Rochester, NY (US); Fusheng Xu, Webster, NY (US); Jack Gaynor Elliot, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 108 days.

(21) Appl. No.: 13/554,701

(22) Filed: Jul. 20, 2012

(65) Prior Publication Data

US 2014/0022298 A1 Jan. 23, 2014

(51) Int. Cl.

| | |
|---|---|
| ***B41J 29/393*** | (2006.01) |
| ***B41J 25/308*** | (2006.01) |
| *B41J 11/00* | (2006.01) |

(52) U.S. Cl.

CPC ..... *B41J 29/393* (2013.01); *B41J 25/308* (2013.01); *B41J 11/0095* (2013.01)

USPC ..... 347/19

(58) Field of Classification Search

CPC .... B41J 29/393; B41J 25/308; B41J 11/0095; B41J 2/04526

USPC ..... 347/8, 14–16, 19, 101, 104

See application file for complete search history.

(56) References Cited

U.S. PATENT DOCUMENTS

| | | | | |
|---|---|---|---|---|
| 8,186,787 | B2 * | 5/2012 | Holbrook et al. | 347/8 |
| 8,419,144 | B2 * | 4/2013 | Castillo et al. | 347/8 |

* cited by examiner

*Primary Examiner* — An Do

(74) *Attorney, Agent, or Firm* — Hoffmann & Baron, LLP

(57) ABSTRACT

An indirect media flatness measurement system, and method, by which the appropriate level of hold-down force may be determined with some degree of quantitative accuracy. In an ink jet printer that is operative to subject a substrate media to a hold down force during printing, the method including printing a predetermined test image having a predetermined pattern on a substrate media using an ink jet print apparatus to produce a test print. Optionally, pattern may be an array of test symbols. The test symbol may include a line printed on the substrate media in a direction perpendicular to a process direction of the printer. The test print is compared with the predetermined test image, including measuring drop placement errors of test symbols. The height of the substrate media at the location of each test symbol is calculated based upon the drop placement error.

28 Claims, 6 Drawing Sheets

INDIRECT MEDIA FLATNESS MEASUREMENT

BACKGROUND

1. Field of the Disclosure

The present disclosure relates to methods of document creation. More specifically, the present disclosure is directed to a method and apparatus for indirectly measuring the flatness of a substrate media upon which an image is printed by an ink jet print system.

2. Brief Discussion of Related Art

In certain printers using ink jet technology, it is expected that inks, e.g., solid inks, UV inks, aqueous inks, and functional inks including those used in 3D printing application or printed electronics, among others, will be jetted directly onto substrate media, often a cut sheet. A critical parameter in this printing process is the size of the printhead-to-media gap. In certain current technology, the gap is set as small as 0.5 mm in order to minimize the pixel placement errors due to misdirected jets. For other printheads, for example those having relatively higher drop velocity, it is possible that the gap can be opened to between about 0.75-1.0 mm.

For accurate pixel placement and color registration, it is desired to keep the printhead-to-media gap within a +/−0.1 mm range about the nominal. To avoid printhead front face damage, under no circumstances is the media allowed to "close the gap", i.e., to contact the printhead. Both vacuum and/or electrostatic escort belt, drum or plate technology are employed to hold cut sheets of substrate media sufficiently flat. However, these tight printhead-to-media tolerances pose a challenge for any cut sheet printer, since the cut sheet body is generally not perfectly flat.

One solution to the problem of upcurl is that a cut sheet printer may have a precurler subsystem which biases all sheets into a downcurl mode. However, sheets may not be held sufficiently flat in the printing zone, to the extent that a shutdown of the printer would be necessary to avoid the media contacting the printheads.

Therefore, the cut sheet media is subjected to a hold-down force, for example of electrostatic and/or vacuum pressure origin, as it is carried by the escort belt through a printing zone. Moreover, the images are formed in a dynamic process, whereby the substrate media is carried in a continuous and preferably high quality motion past the ink jet aperture array. Under the influence of the hold-down force, the substrate media is presumed to be held perfectly flat against the surface of the escort belt, drum or plate.

A known difficulty in the technology is that the presumption of media flatness past the ink jet aperture printing array may not hold. In particular, media supplied with a "pre-curl", or curvature which biases the media to form an arc that would tend to lift the center of the substrate media off the surface of the escort belt, drum or plate, supported by its edges, i.e., a lead edge (LE) and a trail edge (TE), considered in the process direction. This bias is then overcome by the applied hold-down force. However, without the ability to measure the flatness of the media in the printing zone, the necessary amount of hold-down force is subject to some speculation. In order to overcome this, the hold-down force is intentionally over-applied, which is at least a source of inefficiency.

SUMMARY

Therefore, in order to overcome these and other weaknesses, drawbacks, and deficiencies in the known art, it is an object of the present disclosure to provide a method of media flatness measurement, by which the appropriate level of hold-down force may be determined with some degree of quantitative accuracy. Therefore, provided according to the present disclosure is a method for media flatness measurement in an ink jet printer that is operative to subject a substrate media to a hold down force during printing, the method including printing a predetermined test image having a predetermined pattern on a substrate media using an ink jet print apparatus to produce a test print. The pattern may be an array of test symbols. Optionally, the test symbol may comprise a line printed on the substrate media in a direction substantially perpendicular to a process direction of the printer. The test print is compared with the predetermined test image, including measuring drop placement errors of test symbols. The height of the substrate media at the location of each test symbol is calculated based upon the drop placement error, and compared to a threshold.

In further embodiments of the instant method, a plurality of test prints are produced, each subject to respectively different hold-down force during printing. A minimum hold-down force consistent with the height of the substrate media not exceeding the predetermined threshold is thereafter determined.

In certain embodiments, comparing the test print with the predetermined test image comprises scanning the test print with one of an inline image capture unit and a flatbed image scanner, which may include comparing the scan of the test print with data that was a source of the test image. Where used, an inline image capture unit may comprise one or more of an optical sensor array, and/or a source of electromagnetic emissions.

In further embodiments of the present method, printing a predetermined test image further comprises selecting one or more of a jetting frequency, a drop velocity and a substrate media velocity in order to affect a sensitivity of the drop placement error to variations in substrate media height. In particular, the drop velocity may be chosen as uniform.

Also disclosed by the instant specification is a non-transitory computer readable medium storing a program of instruction which, when executed by a processing device, cause an ink jet printer operative to subject a substrate media to a hold down force during printing to perform a method of media flatness measurement, the method comprising the foregoing characteristics.

The present disclosure also provides for a printer having a media transport operative to receive a substrate media and to convey the substrate media into, through, or out of a printing zone of the printer, the printing zone being an area associated with the printer in which the substrate media is printed with an image, and a hold-down system operative to generate a hold-down pressure applied to the substrate media in the direction of the first media transport. An image capture unit is operative to capture an image printed on the substrate media by the printer.

The system further includes a controller and a machine-readable storage medium with a program of instruction, which when executed by the controller, cause the printer to print a predetermined test image comprising a predetermined array of test symbols on a substrate media using an ink jet print apparatus to produce a test print and compare the test print with the predetermined test image, including measuring drop placement errors of test symbols. The height of the substrate media at the location of each test symbol is calculated based upon the drop placement errors.

Optionally, the instructions may further causes the printer to produce a plurality of test prints, each subject to respectively different hold-down force during printing, and determining a minimum hold-down force consistent with the height of the substrate media not exceeding the predetermined threshold from measurement of the plurality of test prints. The image sensor may comprise one of an inline image sensor and a flatbed image scanner. The inline image sensor may have one or more of a CMOS array and a source of electromagnetic emissions. Comparing the test print with the predetermined test image may further include comparing the scan of the test print with data that was a source of the test image.

In further embodiments of the system, the printer selects one or more of a jetting frequency, a drop velocity and a substrate media velocity in order to affect a sensitivity of the drop placement error to variations in substrate media height. The drop velocity may be chosen as uniform in the printer. The test symbol may include a line printed on the substrate media in a direction perpendicular to a process direction of the printer.

These and other purposes, goals and advantages of the present disclosure will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings, in which like reference numerals refer to like structures across the several views, and wherein.

DETAILED DESCRIPTION

Introduction

As used herein, a "printer" refers to any device, machine, apparatus, and the like, for forming images on substrate media using ink, toner, and the like. A "printer" can encompass any apparatus, such as a copier, bookmaking machine, facsimile machine, multi-function machine, etc., which performs a print outputting function for any purpose. Where a monochrome printer is described, it will be appreciated that the disclosure can encompass a printing system that uses more than one color (e.g., red, blue, green, black, cyan, magenta, yellow, clear, etc.) ink or toner to form a multiple-color image on a substrate media.

As used herein, "substrate media" refers to a tangible medium, such as paper (e.g., a cut sheet of paper, a continuous web of paper, a ream of paper, etc.), transparencies, parchment, film, fabric, plastic, vellum, paperboard, up to between about 26 and 29 point (i.e., about 0.026-0.029 in. thickness), or other substrates on which an image can be printed or disposed.

As used herein "process path" refers to a path traversed by a unit of substrate media through a printer to be printed upon by the printer on one or both sides of the substrate media. A unit of substrate media moving along the process path from away from its beginning and towards its end will be said to be moving in the "process direction".

As used herein, "transport" when used as a noun, "media transport" or "transport apparatus", each and all refer to a mechanical device operative to convey a substrate media through a printer.

As used herein, "upcurl", is substrate media curvature towards the printhead, in other words curl around a radius centered on the side of a cut sheet substrate media in the same direction as the printhead.

As used herein, "downcurl" is curvature in the substrate media around a radius centered on the side of the cut sheet away from the printhead, for example in the direction of an escort belt, drum or plate.

Description

Figure 1:
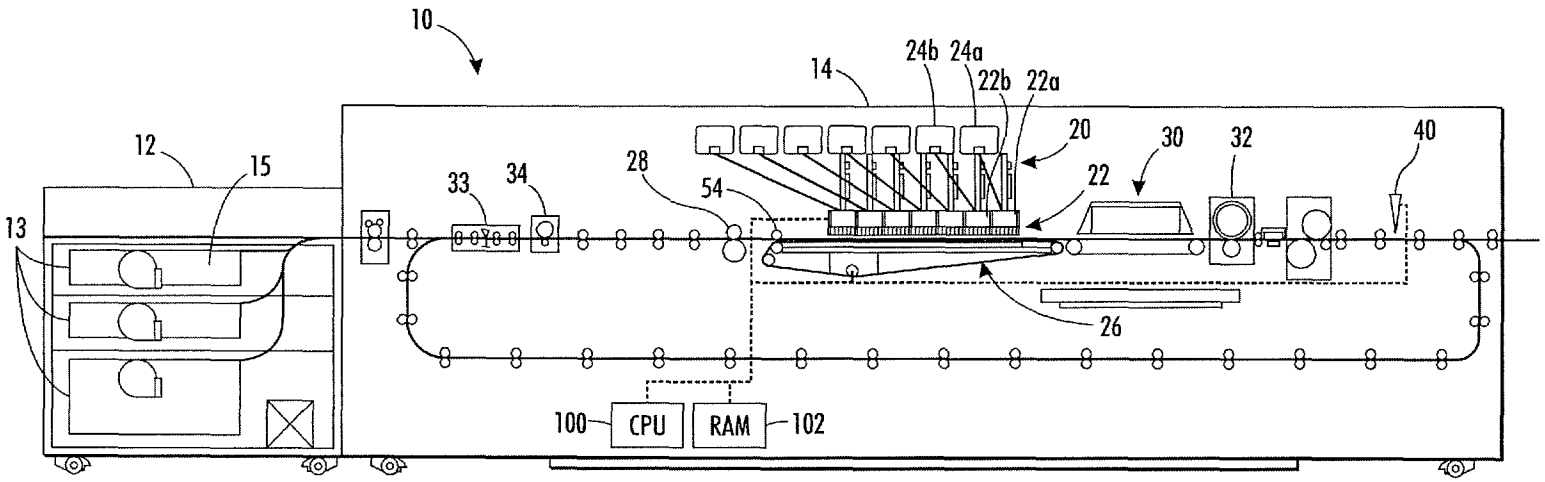
FIG. 1 illustrates schematically a printer according to an exemplary embodiment of the present disclosure.

Referring now to FIG. 1, illustrated is a printer, generally 10, according to a first embodiment of the present disclosure. The printer 10 may include a media feeding unit 12 in which one or more types of substrate media 15 may be stored and from which the substrate media 15 may be fed, for example sheet-by-sheet feeding of a cut sheet medium, to be marked with an image. The media feeding unit 12 delivers substrate media 15, for example from one or more media trays 13, to a printing unit 14 to be marked with a document image. The printing unit 14 delivers printed substrate media 15 to an interface module (not shown) which may, for example, prepare the substrate for a finishing operation. Optionally the printer 10 may include a finishing unit (not shown), which receives printed documents from the interface module. The finishing unit, for example, finishes the documents by stacking, sorting, collating, stapling, hole-punching, or the like. Alternately, the features, structures and/or function of the media feeding unit 12, the interface module and/or the finishing unit may be integrated into the printing unit 14.

Printing unit 14 includes a printing zone, generally 20, within the printing unit 14. A printing zone 20 encompasses a printing engine, in this example an ink jet printing engine, having one or more print heads 22*a*, 22*b*, etc., collectively print head array 22, any of which are operative to directly mark the substrate media 15 and thereby form an image on the substrate media 15. Ink jet print head configuration is not the exclusive printing engine, and is offered as an example only. The ink jet print heads 22*a*, 22*b*, etc. may draw ink from respective reservoirs 24*a*, 24*b*, etc., or in some instances a collective reservoir (not shown). A printing zone transport 26 is operative to hold a substrate media 15 to itself, for example by electrostatic means or vacuum means, without limitation. In other embodiments, the printing engine may comprise any technology for printmaking or document creation in which a controllable gap must be maintained between the printing member and the surface of the substrate media 15.

The printing zone transport 26 is further operative to receive a substrate media 15 delivered towards the printing zone 20, for example from roller nips 28, and to convey the substrate media 15 towards, into, through, out of, and/or away from the printing zone 20, with positive control of the motion of the substrate media 15. The printing zone transport 26 maintains the substrate media 15 within the printing zone 20 in sufficient proximity to the print head array 22 to permit print heads 22*a*, 22*b*, etc. to mark the substrate media 15, but is designed and operated to avoid any contact between the substrate media 15 and the print head array 22. Contact between the substrate media 15 and the print head array 22 is to be avoided to negate the possibility of damage to the precise size and shape of the ink jet openings in the print head array, or to any coatings applied thereto, for example those which may facilitate precise ink particle/drop formation. Such damage may be caused by impact or abrasion due to contact with the substrate media 15. Contact between the substrate media 15 and the print head array 22 may also be the cause media jams leading to unscheduled stoppage of printing, wasting media and ink, requiring operator attention to service the error, and generally lead to customer dissatisfaction.

The printing zone transport 26 is described and depicted in this and other embodiments including a moving belt to provide motion to the substrate media 15. In other embodiments described hereinafter, and/or the implementation of which will be apparent to those of skill in the art by their inclusion in the present description, drum- or cylinder-based escort technology and/or platen technology may be used in combination with or in substitution for a belt-based mechanism. Furthermore, the frame of motion may be reversed, i.e., the substrate media 15 may be held nominally flat and/or immobile on a belt, drum or plate, with a print head array 22 being movable over the surface of the substrate media 15 in order to facilitate forming an image thereon.

Optionally included in the printing unit 14 are a curl sensor 33 and precurler unit 34, preferably upstream in the process path of the printing zone transport 26. The precurler unit 34 is operative to apply a selectable degree of pre-curl to the substrate media 15. In particular, a degree of curl in the substrate media 15 is detected by curl sensor 33. The precurler unit 34 receives output from the curl sensor 33 in setting a desired degree of precurl.

Figure 2:
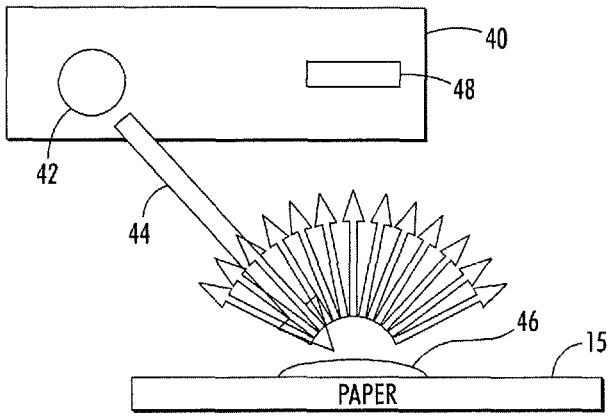
FIGS. 2 and 3 illustrate, schematically, an image sensor in side view and bottom view, respectively, according to one embodiment of the present invention.
Figure 3:
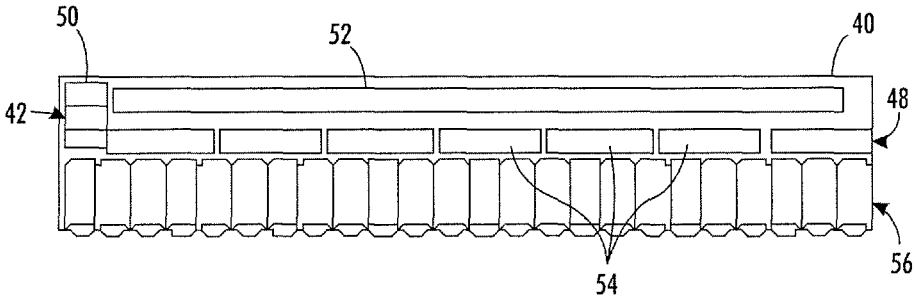

Optionally, though not essentially, according to a further refinement of the present disclosure, the printing unit 14 may further include an image capture unit 40 located and operative to detect an image formed on the substrate media 15. Referring now to FIGS. 2 and 3, illustrated are the image capture unit 40 in its exemplary location, in side view (FIG. 2), and bottom view (FIG. 3). The image capture unit may be embodied as a point scanning sensor, a one-dimensional array, or two-dimensional array. The imaging capture unit 40 may, as in this case, include an illuminator 42 that directs electromagnetic spectrum energy 44, which may include light within or outside the visible spectrum, onto the substrate media 15. The substrate media will optionally have been marked with an image 46 or some part thereof. The image 46 is detected by a detector 48 of the image capture unit 40. Turning then to FIG. 3, the illuminator 42 includes a light source 50 such as LED, incandescent, florescent, phosphorescent, etc. source powered by any of electrical, chemical or other energy sources. A light guide 52 distributes energy 44 from the source 50. For example, the image capture unit 40 is optionally arranged across the width of the substrate media 15, or alternately the print zone transport 26, to detect the entire or substantially the entire image 46. The detector 48 may include one or more optical sensor arrays 54 distributed along the image capture unit 40. The optical sensor array 54 may be embodied as one or more of a CMOS, CCD or hybrid. Finally a lens or lenses 56, for example rod lenses or collimating lenses, may be provided to assist in distributing the energy 44 and/or capturing the image 46.

The optical sensor arrays 54 provided in the detector 48 have the capacity to image in full color (including beyond the visible spectrum) or monochrome at up to 35 MHz, and given the position of the image capture unit 40 immediately downstream of the print zone 20 in the process direction, the image 46 is detected as the substrate media 15 is passed beneath the image capture unit 40 by the print zone transport 46. It will be appreciated however that in this position, the image 46 will have been subject to any post-printing processes, e.g., leveling, spreading and/or drying of the inks. However, alternate positions may be used, taking into account that the image detection may be affected by detecting the image 46 without having undergone these processes.

Alternately, the test image 46 may be measured in an off-line manner, i.e., after the substrate media 15 has completed the printing process. Towards this end, the document 60 having the test image 46, may se scanned by any known means, for example CCD and/or flatbed image scanner (neither shown). Such off-line image scanning features may be integrated into the printing unit 14, interface unit, or finishing unit, if desirable, or can be embodied in a separate and/or independent unit.

In a dynamic ink jet printing process herein described, an ink drop is ejected from the print head array 22 at a predicted timing according to the motion of the printing zone transport 26 carrying the substrate media 15 beneath the print head array 22, in order to produce a predetermined image 46 or part thereof. At least part of the process requires a highly predictable gap between the aperture of the print head array 22 and the substrate media 15. The size of this gap will vary unpredictably when the substrate media 15 is not held flat. In particular, a nominal time of flight of the ink drop between the aperture of the print head array 22 and the substrate media 15 may be predicted. On the other hand, in the case where the substrate media 15 is not held flat, the position of the drop will be determined by and indicative of the true gap between the substrate media 15 and the aperture of the print head array 22.

Accordingly, in order to determine the flatness of a substrate media 15 as held in the printing zone 20 by the printing zone transport 26, the instant disclosure proposes to generate a test image on the substrate media 15. The test image has a predetermined pattern. A pattern may be an array of test symbols. As an example only, in the present embodiment, the predetermined test symbols comprise an array of "–" dash symbols, or alternately "+" symbols, cross-hairs, copy marks or the like. Moreover, according to the present embodiments, though not necessarily limited thereto, the test symbols are arranged in a uniform and repeating rectangular pattern. The test symbols need be no more than one drop in thickness, as measured in the process direction or a direction transverse or perpendicular to the process direction.

Once printed, the test image output from the particular print head array 22 may be compared against the theoretical test image. Where the symbols are displaced from their ideal position downstream in the process direction, it may be presumed that the gap between the print head array 22 and the substrate media 15 at that position was smaller than the ideal nominal gap, because the smaller gap decreased the drop time of flight, and thereby arriving at the substrate media 15 before it was intended. Conversely, where a symbol is displaced upstream in the process direction, it may be inferred that the gap between the substrate media and the ink jet aperture was greater than referenced.

Figure 4:
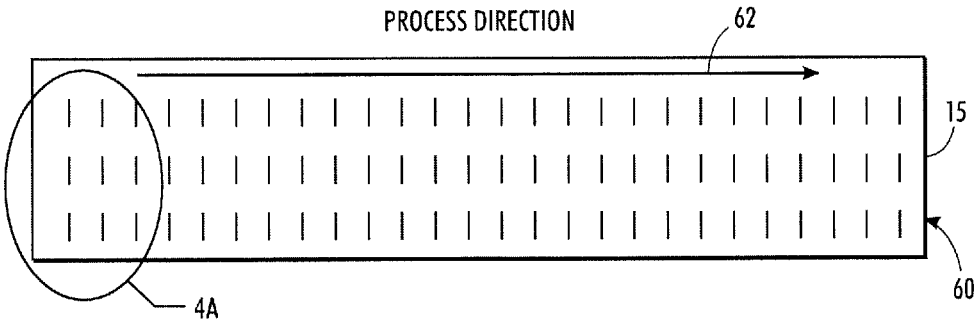
FIG. 4 illustrates a substrate media having a test image printed thereon according to one exemplary embodiment of the present disclosure.
Figure 4A:
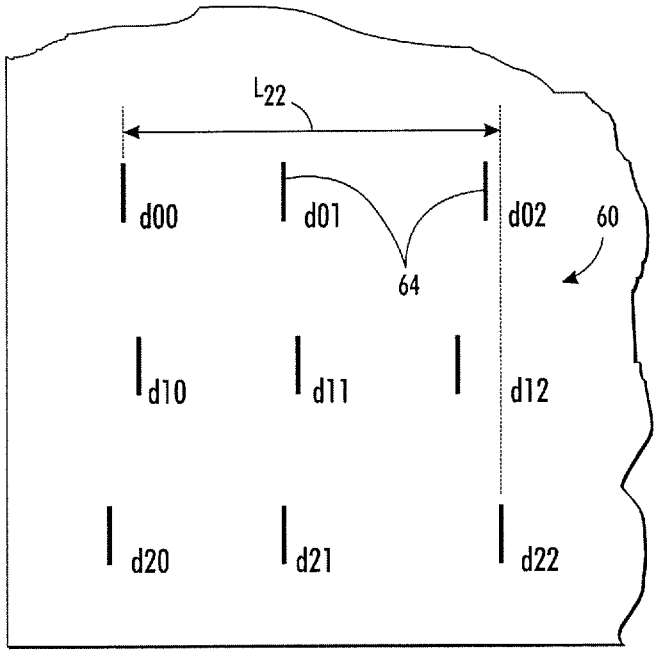
FIG. 4A illustrates a subsection of the test image indicated within circle 4A of FIG. 4, in greater detail.

Referring now to FIGS. 4 and 4A, FIG. 4 illustrates a substrate media 15 having a test image, generally 60, printed thereon. FIG. 4A illustrates a subsection of the test image 60 indicated within circle 4A of FIG. 4, in greater detail. In this example the test image 60 is a rectangular array of line segments 64, each one pixel in thickness in the process direction 62. For the purposes of this example, the substrate media 15 process speed is 1 m/s, and the ink drop velocity is 3 m/s. The print head array 22 will have been normed such that the ink drop velocity is uniform. The nominal gap between the print head array 22 and the substrate media 15 surface is 1 mm, and the paper flatness will be considered to vary within a 0.5 mm range. The jetting frequencyfof the print head array 22 is set to 200 Hz.

Designate the first dash in the first row d00, the second dash in the first row d01 and so on. Generically stated dxy, where x designates the number of the row in which the mark is positioned, and y designates the number of the column. To calculate the paper height difference between d22 and d00, the distance L22 between d22 and d00 along the process direction 46 is measured. Since the jetting frequencyfand substrate media 15 process speed $v_p$ are known, the expected distance between d22 and d00 along the process direction is $2v_p/f$. Thus, the drop flight time error for dash d22 with respect to d00 may be calculated as $(L22-2v_p/f)/v_p$. The height difference H22 is $(L22-2v_p/f)v_d/v_p$, where $v_d$ is drop velocity, set to 3 m/s.

Similarly the height Hxy of the paper at any test mark 64, may be calculated with respect to the reference point d00. Therefore the 2D height contour of media flatness can be deduced. The generalized formula to calculate flatness at a given point in the array 60 is $$H_{xy}=\Delta L_{xy}\cdot v_d/v_p \qquad \text{Equation 1}$$

The drop placement error $\Delta L_{xy}$ is related to media height $H_{xy}$ by $$\Delta L_{xy}=H_{xy}\cdot v_p/v_d \qquad \text{Equation 2}$$

Under the given conditions, drop placement error due to media height variation is 166 μm, which is large enough to be detected by an inline full width array as image capture unit 40. In order to increase the sensitivity of the disclosed method, one can increase the process speed and decrease drop to paper velocity, at least during the hold down calibration.

By way of experimental validation, an experiment was carried out with the printer including a printhead and having a jetting frequency of 39 kHz. The substrate media 15 is a pre-curled cut sheet of paper, and is passed through the print zone 20 by the print zone transport 26 at 1.65 m/s. The gap between print head array 22 and the paper surface is nominally lmm. After printing, the test image 60 is scanned and the test pattern is analyzed to show the distortion caused by the paper curl.

Figure 5:
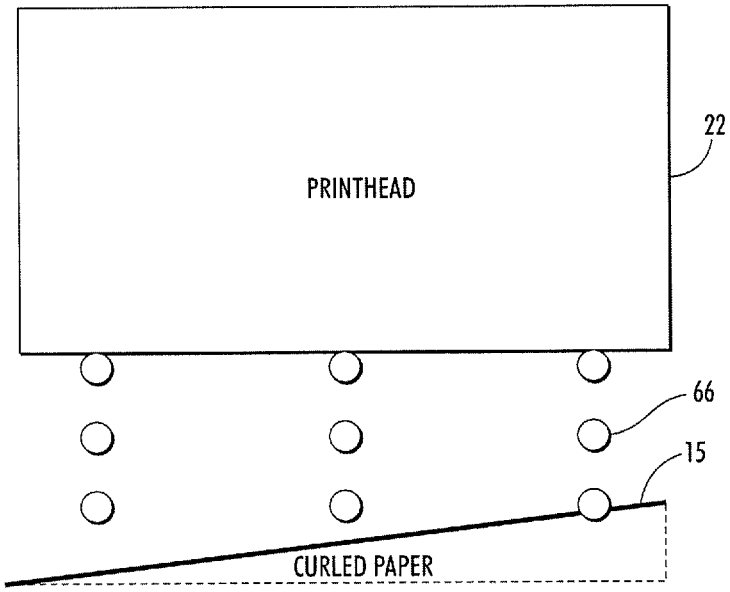
FIG. 5 illustrates schematically in a cross section view aligned with the process direction, an experimental validation according to the present disclosure.

Referring to FIG. 5, illustrated schematically is a cross section view aligned with the process direction, showing the substrate media 15 beneath the print head array 22, with ink drops 66 represented. The media 15 is curled along the cross-process direction. For the purpose of this validation experiment, the print head array 22 is about 3 inches wide and the paper is cut to be only 3 inches wide as well. The right side of media 15 is about 0.8 mm higher than the left side due to a 0.8 mm thick spacer. A test pattern of cross-hairs was printed on the substrate media 15 in this configuration, and the printed image was scanned and compared to the theoretical test image 60, for example by comparison to a postscript file driving the print head array 22.

Figure 6:
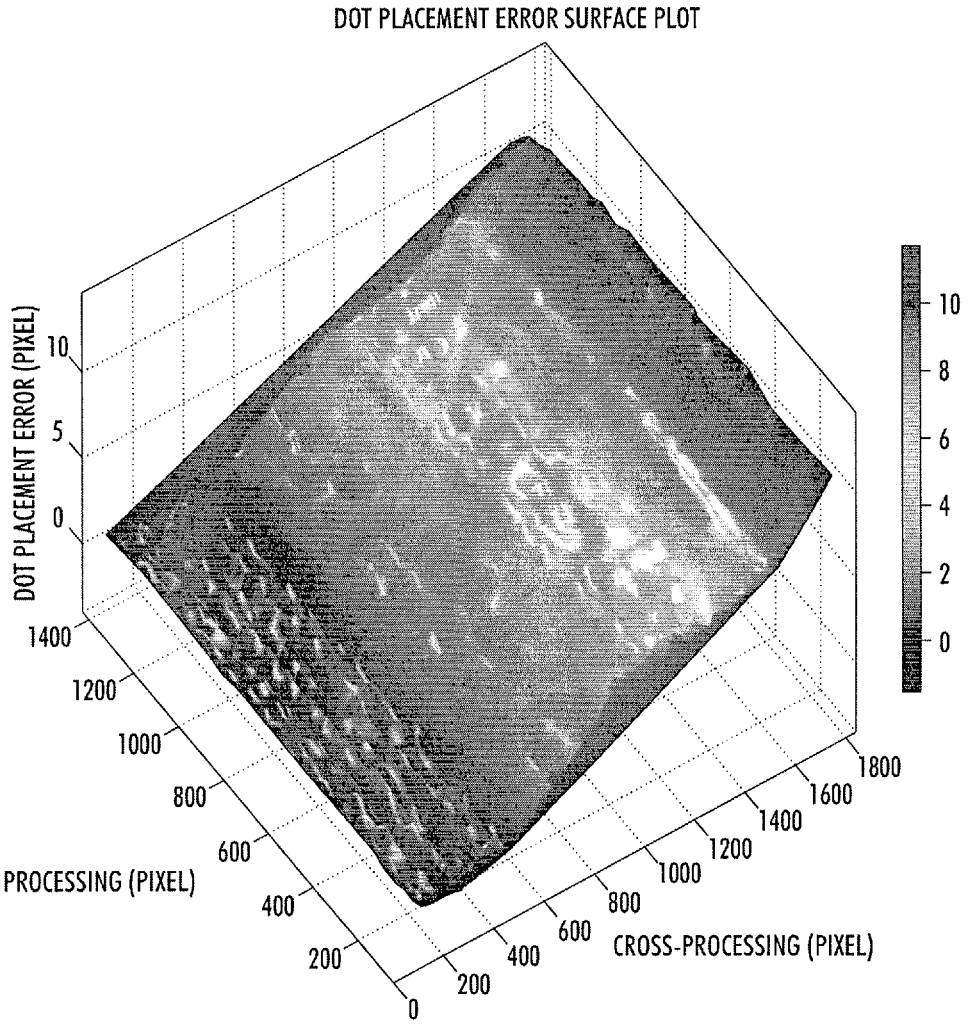
FIG. 6 illustrates a three-dimensional plot of example experimental results of drop placement error as a function of location.
Figure 7:
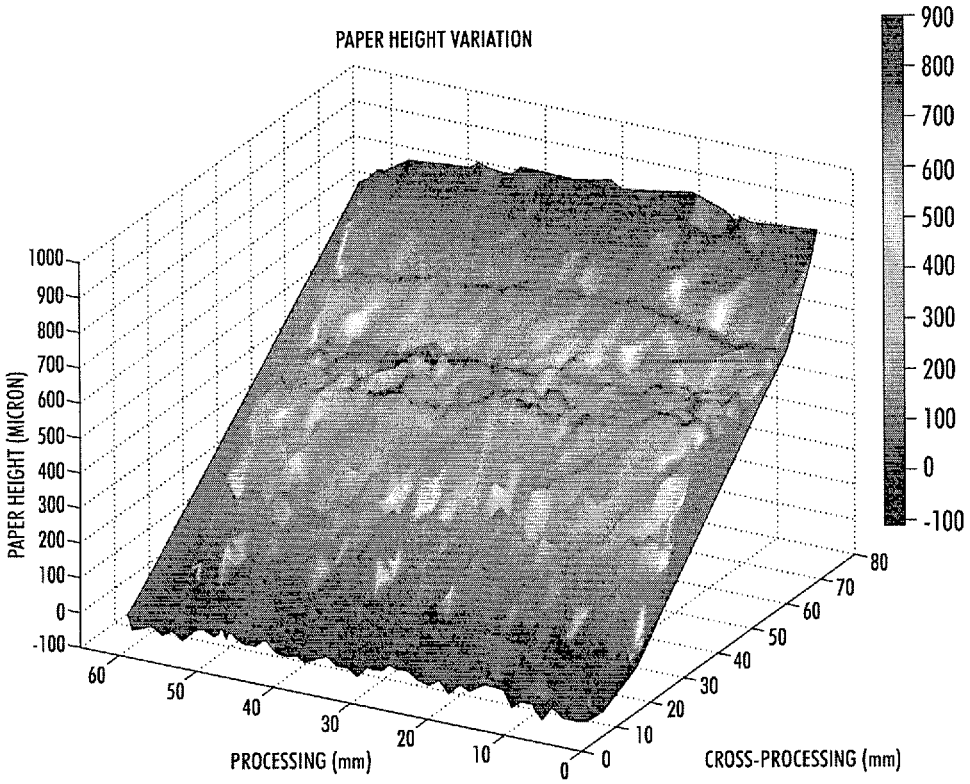
FIG. 7 illustrates a three-dimensional graph converting the drop placement errors depicted in FIG. 6 to substrate media height.

FIG. 6 illustrates a three-dimensional plot of the experimental results. Specifically shown in FIG. 6 is a measurement of drop placement error in the test image as compared to the theoretical. Two characteristics are clearly visible from the data in FIG. 6. First is the clear slope in the cross-process direction, attributable to the spacer. The second is the rise in height at the center of the sheet, attributable to the pre-curl in the cross-process direction, though still within acceptable tolerances. FIG. 7 illustrates the conversion of the drop placement error to substrate media height using Equation 1. Roughness visible in the plot of FIG. 7 is largely attributable to data noise, and is calculated at less than 0.5 pixels or 50 microns. One calculation of signal-to-noise ratio based on the experimental data is 256.

Further, from the foregoing disclosure one can see that the sensitivity of the drop placement error can be influenced by adjustment of input values. For example, reduction of the velocity of ink drops 66, and/or increasing the process velocity, at least temporarily for the purposes of the flatness measurement, will increase the sensitivity of the position error in the process direction with respect to gap distance, making the errors easier to detect, for example using inline methods.

As a further refinement of the instant disclosure, it is considered that the methods described for measuring media flatness can be combined with control of the application of hold-down forces by the print zone transport 26 to determine an optimal level of hold-down force. For example, where the hold-down force is applied by the application of negative or vacuum air pressure, this is accompanied by noise levels related to the strength of the vacuum drawn and/or applied. Therefore, there is a benefit to be gained in terms of increased user satisfaction, etc., by not exceeding the vacuum hold down force necessary to maintain media flatness within the predetermined threshold. Regardless of the precise nature of the hold-down force (e.g., vacuum, electrostatic, or others), determining the minimum force consistent with sufficient flatness yield energy savings. The benefits to flow from such optimization are apparent, but particularly advantageous if a printer is to be made portable and reliant on a self-contained power source.

It is contemplated that this hold-down force management may entail iterative test pattern printing followed by subsequent imaging and measurement. A maximum threshold of media flatness may be set, and corresponding test patter images printer, with measurements taken of each test image correlated with various levels of hold-down force applied. From iterative measurements, a minimum level of hold down force consistent with a maximum media flatness threshold can be ascertained. The process may be repeated for various media types and/or degrees of precurl applied.

It will be appreciated by those skilled in the art that the sensor interpretation and/or decisions described above may be carried out by a machine operator having a suitable interface mechanism, and/or more typically in an automated manner, for example by operation of a controller having a processor 100 executing a system of instructions stored on a machine-readable medium 102, RAM, hard disk drive, or the like. The instructions will cause the printer 10, including the print head array 22, printing zone transport 26 and image capture unit 40, to operate in accordance with the present disclosure.

Variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A method for media flatness measurement in an ink jet printer that is operative to subject a substrate media to a hold down force during printing, the method comprising:

printing a predetermined test image comprising a predetermined pattern having reference points on a substrate media using an ink jet print apparatus to produce a test print; and comparing the test print with the predetermined test image, including measuring drop placement errors related to the reference points; and calculating the height of the substrate media at the location of each reference point based upon the drop placement error.

2. The method according to claim 1, wherein the predetermined pattern comprises an array of test symbols, a test symbol being selected from the group consisting of dash lines, crosshairs, and regular geometric shapes.

3. The method according to claim 2, wherein the test symbol comprises a dash line printed on the substrate media in a direction perpendicular to a process direction of the printer.

4. The method according to claim 1, further comprising:

producing a plurality of test prints, each subject to respectively different hold-down force during printing;

calculating the height of the substrate media at the location of each reference points of each of the plural test prints based upon the drop placement error; and determining a minimum hold-down force consistent with the height of the substrate media not exceeding a predetermined threshold.

5. The method according to claim 1, wherein comparing the test print with the predetermined test image comprises scanning the test print with one of an inline image capture unit and a flatbed image scanner.

6. The method according to claim 5, wherein comparing the test print with the predetermined test image further comprises comparing the scan of the test print with data that was a source of the test image.

7. The method according to claim 5, wherein the inline image capture unit comprises one or more of an optical sensor.

8. The method according to claim 5, wherein the inline image capture unit comprises a source of electromagnetic emissions.

9. The method according to claim 1, wherein printing a predetermined test image further comprises selecting one or more of a jetting frequency, a drop velocity and a substrate media velocity in order to affect a sensitivity of the drop placement error to variations in substrate media height.

10. The method according to claim 9, wherein the drop velocity is uniform.

11. A non-transitory computer readable medium storing a program of instruction which, when executed by a processing device, cause an ink jet printer operative to subject a substrate media to a hold down force during printing to perform a method of media flatness measurement, the method comprising:

printing a predetermined test image comprising a predetermined pattern having reference points on a substrate media using an ink jet print apparatus to produce a test print; and comparing the test print with the predetermined test image, including measuring drop placement errors of reference points; and calculating the height of the substrate media at the location of each reference point based upon the drop placement error.

12. The non-transitory computer readable medium according to claim 11, wherein the predetermined pattern comprises an array of test symbols, a test symbol being selected from the group consisting of dash lines, crosshairs, and regular geometric shapes.

13. The non-transitory computer readable medium according to claim 12, wherein the test symbol comprises a dash line printed on the substrate media in a direction perpendicular to a process direction of the printer.

14. The non-transitory computer readable medium according to claim 11, the method further comprising:

producing a plurality of test prints, each subject to respectively different hold-down force during printing;

calculating the height of the substrate media at the location of each reference point of each of the plural test prints based upon the drop placement error; and determining a minimum hold-down force consistent with the height of the substrate media not exceeding a predetermined threshold.

15. The non-transitory computer readable medium according to claim 11, wherein comparing the test print with the predetermined test image comprises scanning the test print with one of an inline image capture unit and a flatbed image scanner.

16. The non-transitory computer readable medium according to claim 15, wherein comparing the test print with the predetermined test image further comprises comparing the scan of the test print with data that was a source of the test image.

17. The non-transitory computer readable medium according to claim 11, wherein printing a predetermined test image further comprises selecting one or more of a jetting frequency, a drop velocity and a substrate media velocity in order to affect a sensitivity of the drop placement error to variations in substrate media height.

18. The non-transitory computer readable medium according to claim 17, wherein the drop velocity is uniform.

19. A printer comprising:

a media transport operative to receive a substrate media and to convey the substrate media into, through, or out of a printing zone of the printer, the printing zone being an area associated with the printer in which the substrate media is printed with an image;

a hold-down system operative to generate a hold-down pressure applied to the substrate media in the direction of the first media transport;

an image capture unit operative to capture an image printed on the substrate media by the printer;

a controller; and a non-transitory machine-readable storage medium having a program of instruction thereon, which when executed by the controller causes the printer to print a predetermined test image comprising a predetermined pattern having reference points on a substrate media using an ink jet print apparatus to produce a test print; and compare the test print with the predetermined test image, including measuring drop placement errors of the reference points; and calculate the height of the substrate media at the location of each reference point based upon the drop placement errors.

20. The printer according to claim 19, wherein the predetermined pattern comprises an array of test symbols, a test symbol being selected from the group consisting of dash lines, crosshairs, and regular geometric shapes.

21. The printer according to claim 20, wherein the test symbol comprises a dash line printed on the substrate media in a direction perpendicular to a process direction of the printer.

22. The printer according to claim 19, wherein the program of instruction, when executed by the controller, further causes the printer to produce a plurality of test prints, each subject to respectively different hold-down force during printing;

calculate the height of the substrate media at the location of each reference point of each of the plural test prints based upon the drop placement error; and determine a minimum hold-down force consistent with the height of the substrate media not exceeding a predetermined threshold.

23. The printer according to claim 19, wherein image capture unit comprises one of an inline image capture unit and a flatbed image scanner.

24. The printer according to claim 23, wherein the inline image capture unit comprises one or more of an optical sensor and a source of electromagnetic emissions.

25. The printer according to claim 19, wherein comparing the test print with the predetermined test image further comprises comparing the scan of the test print with data that was a source of the test image.

26. The printer according to claim 19, wherein the program of instruction, when executed by the controller, further causes the printer to select one or more of a jetting frequency, a drop velocity and a substrate media velocity in order to affect a sensitivity of the drop placement error to variations in substrate media height.

27. The printer according to claim 19, wherein the printing zone transport comprises at least one of an escort belt, drum, or plate.

28. The printer according to claim 19, further comprising a print head array movable over the surface of the substrate media to facilitate forming an image thereon.

* * * * *